US007273036B2

(12) United States Patent
Boos et al.

(10) Patent No.: US 7,273,036 B2
(45) Date of Patent: Sep. 25, 2007

(54) HIGH-PRESSURE FUEL PUMP WITH A BALL VALVE IN THE LOW-PRESSURE INLET

(75) Inventors: Burkhard Boos, Lambsborn (DE); Stefan Kieferle, Stuttgart (DE); Matthias Distel, Ostfildern (DE); Achim Koehler, Ditzingen (DE); Sascha Ambrock, Gerlingen (DE); Karsten Ruth, Berlin (DE); Jaroslav Zivny, Jihlava (CZ)

(73) Assignee: Robert Bosch GmbH, Stuttgart (DE)

( * ) Notice: Subject to any disclaimer, the term of this patent is extended or adjusted under 35 U.S.C. 154(b) by 219 days.

(21) Appl. No.: 10/531,268

(22) PCT Filed: Oct. 31, 2003

(86) PCT No.: PCT/DE03/03627

§ 371 (c)(1),
(2), (4) Date: Apr. 13, 2005

(87) PCT Pub. No.: WO2004/040128

PCT Pub. Date: May 13, 2004

(65) Prior Publication Data

US 2006/0013701 A1 Jan. 19, 2006

(30) Foreign Application Priority Data

Oct. 31, 2002 (DE) ..... 102 50 661
Jan. 21, 2003 (DE) ..... 103 02 043

(51) Int. Cl.
*F02M 57/02* (2006.01)

(52) U.S. Cl. ..... 123/446; 417/273; 417/470

(58) Field of Classification Search ..... 417/273, 417/470, 515, 269; 123/446, 450
See application file for complete search history.

(56) References Cited

U.S. PATENT DOCUMENTS

| | | | | |
|---|---|---|---|---|
| 3,682,572 | A * | 8/1972 | Yarger | 417/273 |
| 5,213,482 | A * | 5/1993 | Reinartz et al. | 417/273 |
| 5,876,186 | A * | 3/1999 | Stiefel | 417/273 |
| 6,345,609 | B1 | 2/2002 | Djordjevic | |
| 6,457,956 | B1 * | 10/2002 | Hauser et al. | 417/470 |
| 6,694,950 | B2 * | 2/2004 | Djordjevic | 123/446 |
| 6,764,286 | B2 * | 7/2004 | Hunnicutt et al. | 417/470 |
| 2002/0155008 | A1 * | 10/2002 | Hauser et al. | 417/313 |

FOREIGN PATENT DOCUMENTS

| | | | |
|---|---|---|---|
| DE | 43 07 651 | A1 | 9/1994 |
| DE | 100 39 169 | A1 | 3/2001 |
| DE | 101 17 600 | C1 | 8/2002 |
| EP | 1 357 283 | A2 | 10/2003 |
| WO | WO 02/40857 | A2 | 5/2002 |
| WO | WO 03/048564 | A1 | 6/2003 |

* cited by examiner

*Primary Examiner*—Thomas Moulis
(74) *Attorney, Agent, or Firm*—Ronald E. Greigg

(57) ABSTRACT

A high-pressure a radial piston fuel pump in which the intake valves are embodied as ball valves, which has an advantageous effect on the efficiency of the high-pressure fuel pump. Moreover, the production and assembly of the high-pressure fuel pump of the invention are simplified by the use of ball valves.

18 Claims, 3 Drawing Sheets

HIGH-PRESSURE FUEL PUMP WITH A BALL VALVE IN THE LOW-PRESSURE INLET

CROSS-REFERENCE TO RELATED APPLICATIONS

This application is a 35 USC 371 application of PCT/DE 03/03627 filed on Oct. 31, 2003.

BACKGROUND OF THE INVENTION

1. Field of the Invention

The invention is directed to an improved high-pressure fuel pump for a fuel injection system of an internal combustion engine.

2. Description of the Prior Art

A high pressure fuel pump of the type with which this invention is concerned is known from German Patent DE 101 17 600 which discloses a pump having a housing, a low pressure inlet, a supply chamber in which the fuel is compressed, and an intake valve between the supply chamber and the low-pressure inlet, in which a valve member of the intake valve is braced against a compression spring disposed in the supply chamber.

In this known high-pressure fuel pump, the valve member of the intake valve is embodied as a valve cone.

SUMMARY AND ADVANTAGES OF THE INVENTION

In a high-pressure fuel pump of the invention for a fuel injection system, having a housing, having a low-pressure inlet, having a supply chamber in which the fuel is compressed, having an intake valve between the supply chamber and the low-pressure inlet, a valve member of the intake valve being braced against a compression spring disposed in the supply chamber, the valve member of the intake valve is embodied as a ball.

As a result, production of the high-pressure fuel pump is simplified, since a ball is cheaper to produce than a valve member with a sealing cone and a shaft, of the kind known from the prior art. Moreover, the efficiency of the high-pressure fuel pump of the invention is improved, since a ball together with the sealing seat forms a precisely defined circular sealing line, which despite unavoidable production variations in the manufacture of the valve seat provides very good sealing with respect to the valve seat. If the valve seat that cooperates with the ball is round, then the intake valve of the invention provides very good sealing, even if the angle or the position of the valve seat cannot be produced with extreme precision.

With a high-pressure pump employing the intake valve of the invention, it is also assured that all the intake valves of a mass-produced high-pressure fuel pump have virtually identical hydraulic properties, thus simplifying optimization of the mass-produced high-pressure fuel pump.

In a variant of the invention, a spring plate is disposed between the compression spring and the ball, so that the fixation of the ball relative to the sealing seat is improved, and buckling of the compression spring is furthermore avoided. Moreover, the use of a spring plate makes it possible for the diameters of the compression spring and the ball to be different. It has proved especially advantageous if the diameter of the ball is less than the diameter of the compression spring, since in that case buckling of the compression spring is effectively averted, and the diameter of the ball optimally meets the hydraulic requirements of the high-pressure fuel pump.

In a further feature of the invention, the valve seat that cooperates with the ball is machined into the housing, so that the number of sealing faces subjected to high pressure, and the number of components, are reduced compared to the high-pressure fuel pump known from the prior art. This increases the reliability of the high-pressure fuel pump of the invention and reduces its production and assembly costs.

It has proved advantageous if the valve seat has a seat angle of between 30° and 150°, and in particular between 80° and 100°.

As an alternative to the sealing seat disposed directly in the housing, the housing may also include a screw, which closes off a supply chamber bore from the outside, and in whose end face, toward the supply chamber, the valve seat is made. This variant has the advantage that the intake valve can be installed or removed in the case of repair, for instance, without having to dismantle the high-pressure fuel pump completely, since the intake valve can be reached from outside via the screw.

In a further feature of this variant embodiment, it is provided that the screw has a region of reduced diameter; that the reduced-diameter region together with the housing defines an annular chamber; and that the annular chamber communicates hydraulically with the low-pressure inlet. It is thus assured in a simple manner that regardless of how far the screw has been screwed into the housing, a hydraulic communication with the low-pressure inlet always exists.

The advantages of the invention are understood to come into play in a fuel system with a fuel tank, an injection valve that injects the fuel directly into the combustion chamber of an internal combustion engine, a high-pressure fuel pump, and a fuel collection line to which the at least one injection valve is connected, if the high-pressure fuel pump is embodied in accordance with one of the foregoing feactures.

BRIEF DESCRIPTION OF THE DRAWINGS

Further advantages and advantageous features can be learned from the description contained herein below, taken with the drawings, in which.

DESCRIPTION OF THE PREFERRED EMBODIMENTS

Figure 1:
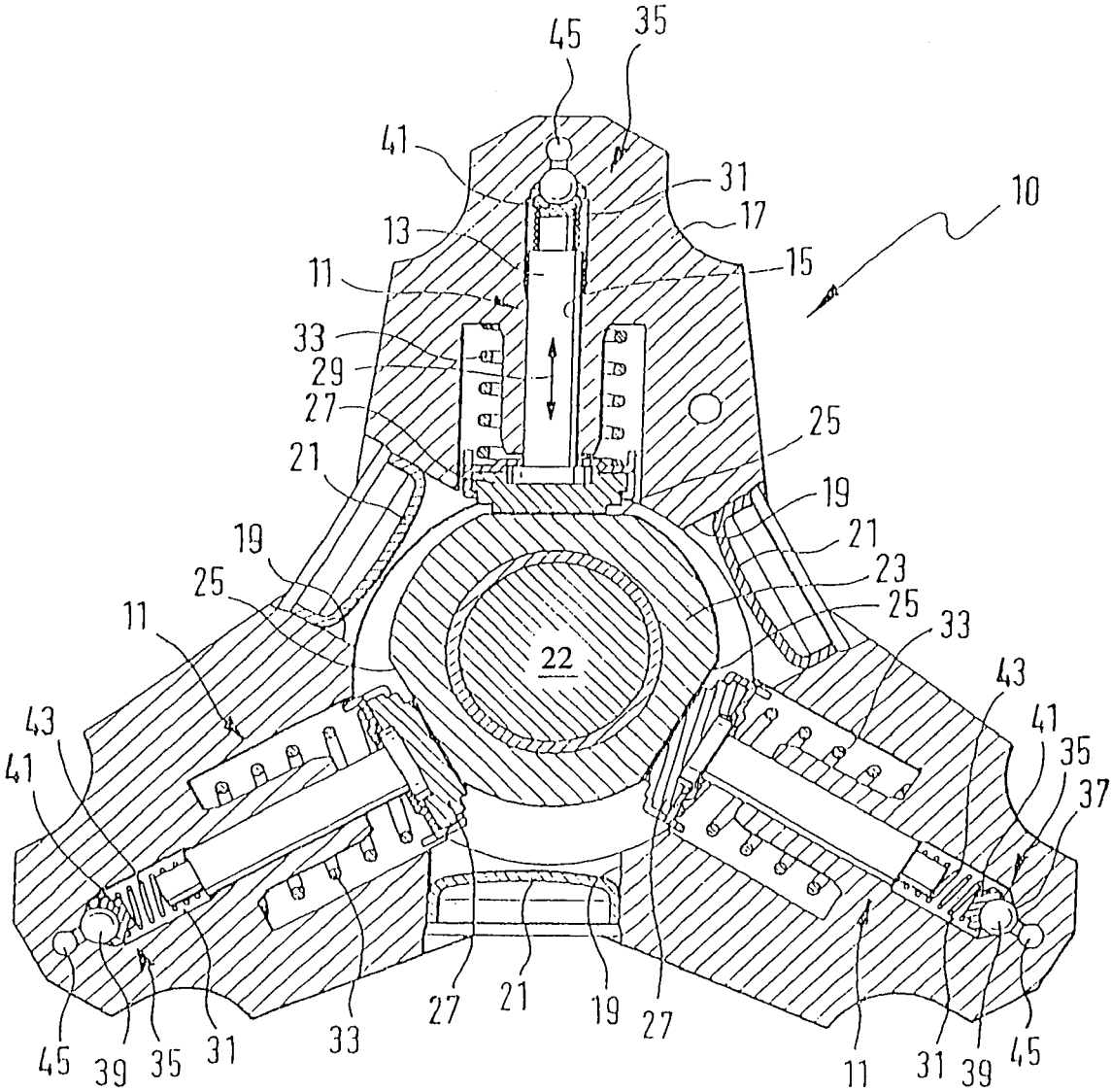
FIG. 1 is a sectional view of a first exemplary embodiment of a radial piston pump of the invention.

FIG. 1 shows a high-pressure fuel pump 10 embodied as a radial piston pump, with three pump elements 11. The pump elements 11 include a piston 13 which is guided in a cylinder bore 15. The cylinder bore 15 is embodied as a blind bore in a housing 17 of the high-pressure fuel pump 10. Via production and assembly bores 19, the cylinder bore can be made. After the assembly of the high-pressure fuel pump of the invention, the assembly bores 19 are closed with plugs 21.

The pistons 13 are driven by a drive shaft with an eccentric portion 22 via a polygonal ring 23 with flat faces 25. A piston base plate 27 rests on the flat faces 25 and causes the piston 13 to execute an oscillating motion when the drive shaft is driven and the polygonal ring 23 consequently executes a circular motion. The oscillating motion of the piston 13 is represented in one of the pump elements 11 by a double arrow 29.

The cylinder bore 15 and the piston 13 define one pump chamber or supply chamber 31 per pump element 11; the volume of the supply chamber 31 depends on the position of the drive shaft. In the pump element 11, oriented vertically upward in FIG. 1, whose piston 13 is near its top dead center (TDC), the volume of the supply chamber 31 is minimal, while for the other pump elements 11 it is virtually at a maximum. By means of a compression spring 33, the piston base plates 27 and with them the pistons 13 are always kept in contact with the flat faces 25 of the polygonal ring 23.

For the sake of simplicity, not all the components of all the pump elements 11 are identified by reference numerals. However, all three pump elements 11 are of identical construction and have identical components.

The cylinder bore 15, as already noted, is embodied as a blind bore. On the end of the cylinder bore 15, an intake valve 35 is provided, having a sealing seat 37 and a ball 39 that cooperates with the sealing seat 37. The ball 39 is pressed against the seat 37, via a spring plate 41, by a compression spring 43 that is braced on its other end on the piston 13.

The compression spring 43 is dimensioned such that at bottom dead center, fuel is not automatically aspirated. If a metering unit, not shown, disposed on the intake side of a high-pressure fuel pump 10, is closed, then the high-pressure fuel pump 10 does not pump any fuel. If the metering unit is fully or partly open, an overpressure generated by a prefeed pump (not shown) builds up upstream of the intake valve 35, by which overpressure fuel is pressed into the supply chamber 31 counter to the compression spring 43. The metering unit has the task of adjusting the overpressure upstream of the suction chamber 31 such that the desired supply quantity is pumped by the high-pressure fuel pump 10.

If the piston 13 has moved in the direction of its top dead center, then the prestressing of the compression spring 43 increases so sharply that the ball 39 is pressed against the sealing seat 37, and thus the communication between the supply chamber 31 and the low-pressure inlet 45 is disrupted. This effect is reinforced very substantially by the increasingly higher pressure in the supply chamber 31.

As an alternative, the compression spring 43 may also be dimensioned such that the ball 39 is still pressed slightly against the sealing seat 37 even at bottom dead center (BDC) of the piston 13. Only if an adequate overpressure, compared to the pressure in the supply chamber 31, prevails on the low-pressure side, not shown in FIG. 1, of the high-pressure fuel pump 10, does fuel flow into the supply chamber 31. The pressure on the low-pressure side of the high-pressure fuel pump 10, that is, the intake side of the supply chamber 31, and hence the supply quantity of the high-pressure fuel pump 10 are adjusted by a metering unit, not shown in FIG. 1, of a control unit (not shown), as a function of the engine operating state.

By these provisions, it is assured that even if the fuel inflow via the low-pressure inlet 45 into the pump elements 11 is throttled by the metering unit, not shown, each of the pump elements 11 aspirates virtually the same fuel quantity, thus producing a uniform torque and power demand for the high-pressure fuel pump 10. This improves the concentricity of the engine, especially in idling.

Because the piston 13, even at top dead center, is not guided over its entire length in the cylinder bore 15, an adequate "overrun" exists for honing tools or the like. This overrun makes it easier to produce the cylinder bore 15 that is embodied as a blind bore.

A high-pressure outlet and the associated pressure valve are not shown in FIG. 1, since the high-pressure outlet and the associated pressure valve are disposed perpendicular to the plane of the drawing, behind the pump elements 11. The disposition of these components can be found in German Patent 101 17 600, which is hereby expressly incorporated by reference.

The use of a spring plate 41 between the ball 39 and the compression spring 43 improves the guidance of the ball 39. Moreover, because of the improved area of contact of the compression spring 43 on the spring plate 41, buckling of the compression spring 43 can be prevented. Finally, the diameter of the ball 39 can be selected independently of the diameter of the compression spring 43, which can be advantageous in optimizing the high-pressure fuel pump 10.

However, it is readily conceivable and possible also to dispense with the spring plate 41 (an option not shown), so that the compression spring 43 rests directly on the ball 39.

In the first exemplary embodiment, shown in FIG. 1, of a high-pressure fuel pump 10 of the invention, there is only a very small number of high-pressure sealing points. These are in particular the sealing seat 37 in conjunction with the ball 39 and the annular gap between the piston 13 and the cylinder bore 15. This low number of high-pressure sealing points in many cases justifies the somewhat greater production cost for producing the cylinder bore 15 if the cylinder bore is embodied as a blind bore.

The specific advantages of an intake valve 35 embodied as a ball valve will be described in detail hereinafter in conjunction with FIG. 3.

Figure 2:
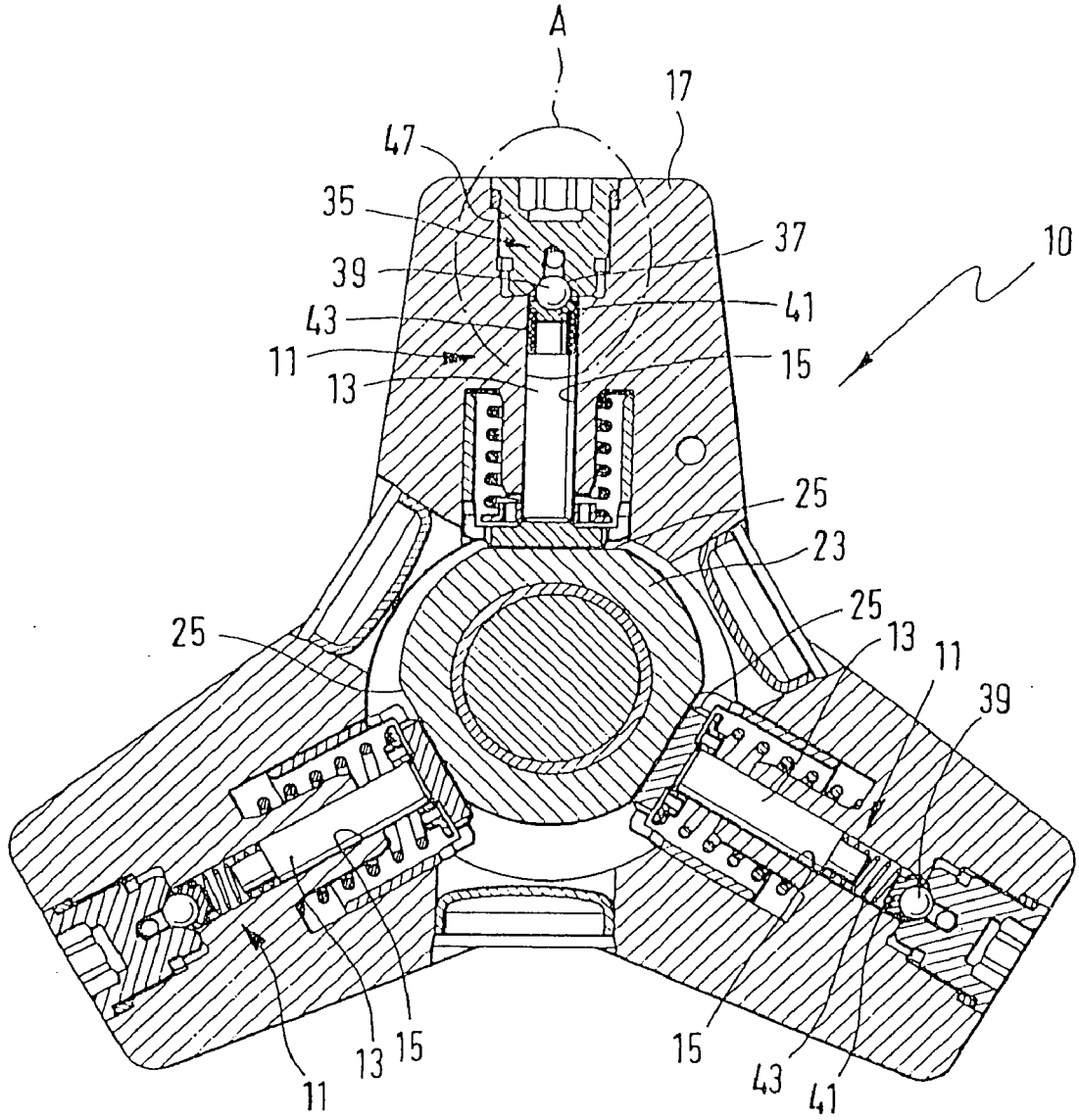
FIG. 2, a second exemplary embodiment of the invention of a radial piston pump.

In FIG. 2, a second exemplary embodiment of a high-pressure pump 10 of the invention is shown, again in section. Identical components are identified by the same reference numerals, and what is said with regard to FIG. 1 applies accordingly. The essential distinction from the first exemplary embodiment is that the cylinder bore 15 is embodied not as a blind bore but as a through bore. In this exemplary embodiment, the cylinder bore 15 is closed by a screw 47. The sealing seat 37 of the intake valve 35 is machined into the screw 47.

The function of the intake valve 35 will now be explained in further detail in conjunction with FIG. 3, which shows an enlarged detail A of FIG. 2.

Figure 3:
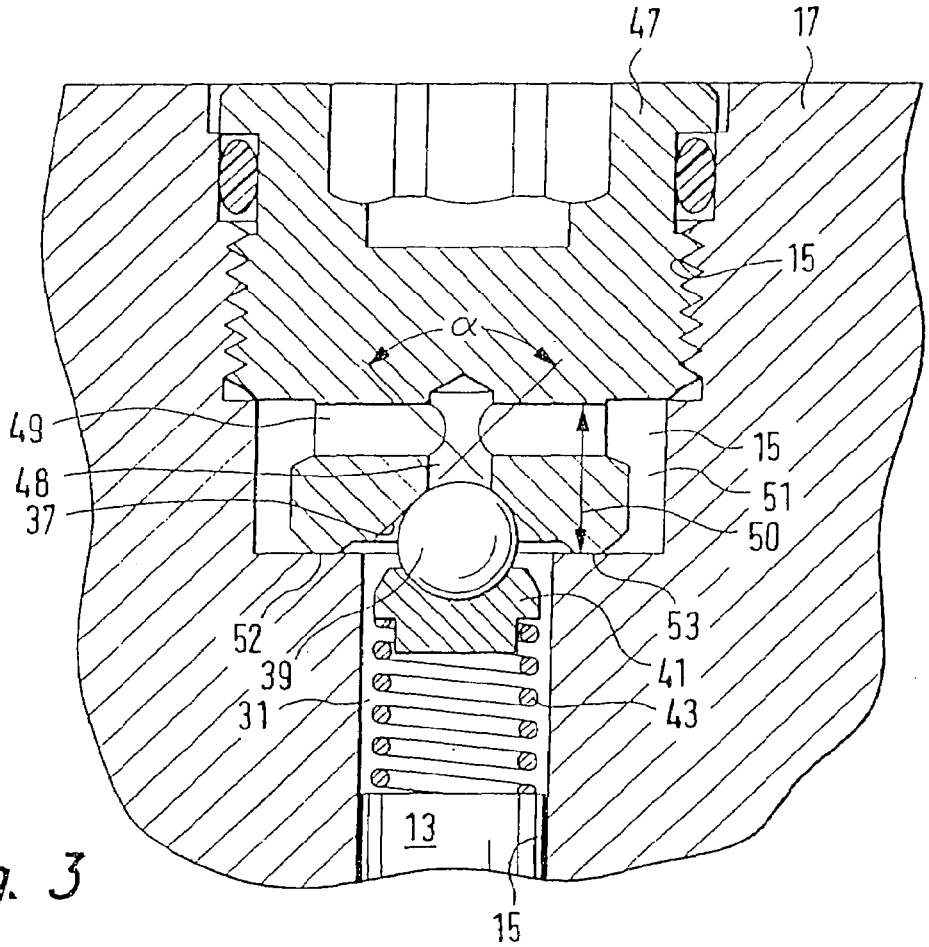
FIG. 3, an intake valve of the invention, shown enlarged.

In FIG. 3, the piston 13 is at top dead center. Accordingly, the supply chamber 31 has its minimal volume, and the ball 39 seals off the supply chamber 31 from the low-pressure inlet 45 of the high-pressure fuel pump 10. This sealing takes place along a circular sealing line (not shown), which results from the line of contact between the ball 39 and the sealing seat 37. The tightness of this intake valve 35 embodied as a ball valve is very high, since there is only linear contact between the ball 39 and the sealing seat 37, resulting in a correspondingly high pressure per unit of surface area on the sealing line. Moreover, the demands for precision in the production of a tightly closing ball valve are less stringent than for conical valves. Depending on the selected angle $\alpha$ of the sealing seat 37, the diameter of the sealing line between the ball 39 and the sealing seat 37 for a constant ball diameter can be varied. It has been found that seat angles $\alpha$ of between 30° and 150° are possible, and as a rule, a seat angle $\alpha$ of 90° leads to very good results.

The sealing seat 37 is adjoined by an axial bore 48 and a transverse bore 49. Alternatively, a plurality of transverse bores 49 (not shown) may be provided. The transverse bore 49 discharges into an annular chamber 51, which is defined by the housing 17 and a reduced-diameter region 50 of the screw 47. On a face end 52 of the screw 47, a biting edge 53 is embodied, which seals off the annular chamber 51 from the supply chamber 31.

The annular chamber 51 communicates hydraulically with the low-pressure inlet 45, not visible in this view, of the high-pressure fuel pump 10. Because the annular chamber surrounds the screw 47 on all sides, fuel can be aspirated into the supply chamber 31 via the transverse bore 49 and the axial bore 48, regardless of how deeply the screw 47 has been screwed into the housing 17.

By the use of an intake valve 35 embodied as a ball valve, the efficiency of the high-pressure fuel pump is increased, since the ball 39 uncovers a large flow cross section, as soon as it lifts from the sealing seat 37, and hence the fuel can be aspirated quickly and without major flow losses. For that purpose, it is also advantageous if with the intake valve 35 open, the annular cross-sectional area between the sealing seat 37 and the ball 39 is approximately up to 20 times larger than the cross section of the transverse bore 49.

Moreover, because of the good sealing properties of the intake valve 35 embodied as a ball valve, during the pumping stroke of the piston 13 no fuel is forced back out of the supply chamber 31 into the low-pressure inlet 45.

Figure 4:
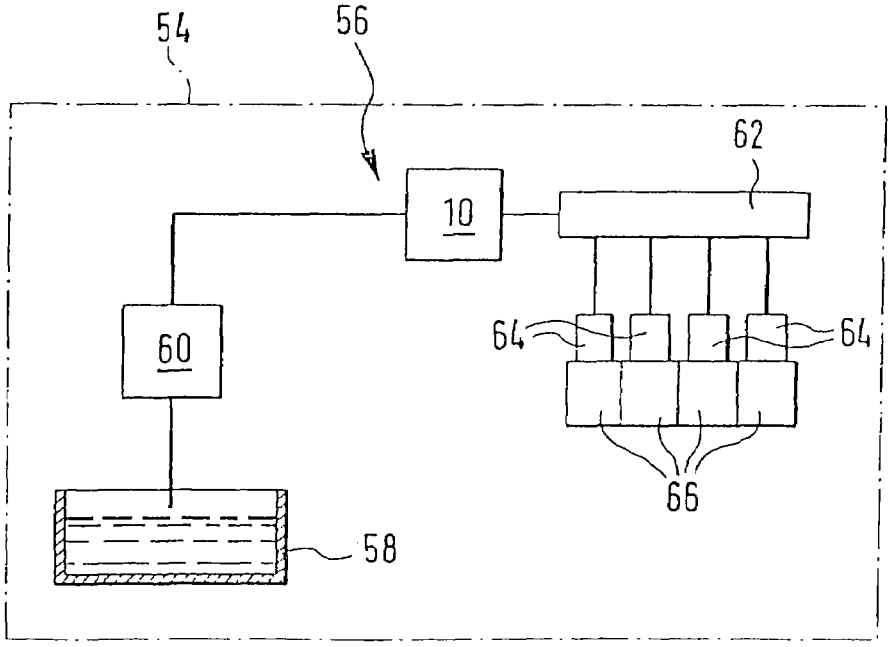
FIG. 4, a schematic illustration of an internal combustion engine equipped with a high-pressure fuel pump of the invention.

In FIG. 4, an internal combustion engine 54 is shown schematically. It includes a fuel injection system 56. The fuel injection system in turn has a fuel tank 58, from which an electric low-pressure fuel pump 60 pumps fuel.

The electric low-pressure fuel pump 60 pumps fuel to the high-pressure fuel pump 10, which is embodied as shown in FIGS. 1 and 2. The high-pressure outlet 18 of the high-pressure fuel pump 10 communicates with a fuel collection line 62. This is generally also called a "common rail". A total of four injection valves 64 are connected to the fuel collection line 62. They each inject the fuel directly into combustion chambers 66 of the engine 54.

The foregoing relates to preferred exemplary embodiments of the invention, it being understood that other variants and embodiments thereof are possible within the spirit and scope of the invention, the latter being defined by the appended claims.

The invention claimed is:

1. A high-pressure fuel pump (10) for a fuel injection system (56), having a housing (17, 47), a piston (13) guided in a cylindrical bore (15) of the housing (17), a base plate (27) in contact with a polygonal ring (23) on a drive shaft of the pump (10), said piston (13) having a first end guided at a first end of said cylindrical bore (15), said piston (13) having a free second end guided within a second end of said cylindrical bore (15), a low-pressure inlet (45) disposed at the second end of the cylindrical bore (15), a supply chamber (31) in which the fuel is compressed by the free end of the piston (13), an intake valve (35) disposed between the supply chamber (31) and the low-pressure inlet (45), a valve member of the intake valve (35) being braced against an end of the piston (13) via a compression spring (43) disposed in the supply chamber (31), and a high-pressure outlet, wherein the valve member of the intake valve (35) is embodied as a ball (39).

2. The high-pressure fuel pump of claim 1, further comprising a spring plate (41) between the compression spring (43) and the ball (39).

3. The high-pressure fuel pump of claim 1, wherein the diameter of the ball (39) is less than the diameter of the compression spring (43).

4. The high-pressure fuel pump of claim 2, wherein the diameter of the ball (39) is less than the diameter of the compression spring (43).

5. The high-pressure fuel pump (10) of claim 1, further comprising a sealing seat (37) in the housing (17, 47) and cooperating with the ball (39).

6. The high-pressure fuel pump (10) of claim 2, further comprising a sealing seat (37) in the housing (17, 47) and cooperating with the ball (39).

7. The high-pressure fuel pump of claim 5, wherein the sealing seat (37) has a seat angle ($\alpha$) of between 30° and 150°.

8. The high-pressure fuel pump of claim 6, wherein the sealing seat (37) has a seat angle ($\alpha$) of between 30° and 150°.

9. The high-pressure fuel pump of claim 7, wherein the seat angle ($\alpha$) is about 90°.

10. The high-pressure fuel pump of claim 8, wherein the seat angle ($\alpha$) is about 90°.

11. The high-pressure fuel pump of claim 5, wherein the housing (17, 47) includes a screw (47), which closes off the second end of said cylinder bore (15) from outside; and wherein the sealing seat (37) is embodied in a face end (52), toward the supply chamber (31), of the screw (47).

12. The high-pressure fuel pump of claim 6, wherein the housing (17, 47) includes a screw (47), which closes off the second end of said cylinder bore (15) from outside; and wherein the sealing seat (37) is embodied in a face end (52), toward the supply chamber (31), of the screw (47).

13. The high-pressure fuel pump of claim 7, wherein the housing (17, 47) includes a screw (47), which closes off the second end of said a cylinder bore (15) from outside; and wherein the sealing seat (37) is embodied in a face end (52), toward the supply chamber (31), of the screw (47).

14. The high-pressure fuel pump of claim 8, wherein the housing (17, 47) includes a screw (47), which closes off the second end of said a cylinder bore (15) from outside; and wherein the sealing seat (37) is embodied in a face end (52), toward the supply chamber (31), of the screw (47).

15. The high-pressure fuel pump (10) of claim 11, wherein the screw (47) has a region (50) of reduced diameter; wherein the reduced-diameter region (50) together with the housing (17) defines an annular chamber (51); and wherein the annular chamber (51) communicates hydraulically with the low-pressure inlet (45).

16. The high-pressure fuel pump (10) of claim 13, wherein the screw (47) has a region (50) of reduced diameter; wherein the reduced-diameter region (50) together with the housing (17) defines an annular chamber (51); and wherein the annular chamber (51) communicates hydraulically with the low-pressure inlet (45).

17. A fuel injection system (56), comprising a fuel tank (58), at least one injection valve (64) which injects the fuel directly into the combustion chamber (66) of an internal combustion engine (54), at least one high-pressure fuel pump (10), and a fuel collection line (62) to which the at least one injection valve (64) is connected, the high-pressure fuel pump (10) having a housing (17, 47), a piston (13) guided in a cylindrical bore (15) of the housing (17), a base plate (27) in contact with a polygonal ring (23) on a drive shaft of the pump (10), said piston (13) having a first end (13) guided at a first end of said cylindrical bore (15), said piston (13) having a free second end guided within a second end of said cylindrical bore (15), a low-pressure inlet (45) disposed at the second end of the cylindrical bore (15), a supply chamber (31) in which the fuel is compressed by the free end of the piston (13), an intake valve (35) disposed between the supply chamber (31) and the low-pressure inlet (45), a valve member of the intake valve (35) being braced against an end of the piston (13) via a compression sprint (43) disposed in the supply chamber (31), and a high-pressure outlet, wherein the valve member of the intake valve (35) is embodied as a ball (39).

18. An internal combustion engine (54), having at least one combustion chamber (66) into which the fuel is injected directly, by a fuel injection system (56) comprising a fuel tank (58), at least one injection valve (64) which injects the fuel directly into the combustion chamber (66) of an internal combustion engine (54), at least one high-pressure fuel pump (10), and a fuel collection line (62) to which the at least one injection valve (64) is connected.

the high-pressure fuel pump (10) having a housing (17, 47), a piston (13) guided in a cylindrical bore (15) of the housing (17), a base plate (27) in contact with a polygonal ring (23) on a drive shaft of the pump (10), said piston (13) having a first end guided at a first end of said cylindrical bore (15), said piston (13) having a free second end guided within a second end of said cylindrical bore (15), a low-pressure inlet (45) disposed at the second end of the cylindrical bore (15), a supply chamber (31) in which the fuel is compressed by the free end of the piston (13), an intake valve (35) disposed between the supply chamber (31) and the low-pressure inlet (45), a valve member of the intake valve (35) being braced against an end of the piston (13) via a compression spring (43) disposed in the supply chamber (31), and a high-pressure outlet, wherein the valve member of the intake valve (35) is embodied as a ball (39).

* * * * *